United States Patent [19]

Ludwig et al.

[11] 4,206,957

[45] Jun. 10, 1980

[54] PROTECTED ELECTRICAL CONNECTOR

[75] Inventors: Melvin S. Ludwig; Hakki M. Tansi, both of Queens, N.Y.

[73] Assignee: Eagle Electric Mfg. Co., Inc., Long Island City, N.Y.

[21] Appl. No.: 8,609

[22] Filed: Feb. 1, 1979

[51] Int. Cl.[2] ..... H01R 13/44

[52] U.S. Cl. ..... 339/40; 339/43

[58] Field of Search ..... 339/36, 40, 41, 43, 339/44 R; 174/167

[56] References Cited

U.S. PATENT DOCUMENTS 3,980,371 9/1976 Kahn et al. ..... 339/40

FOREIGN PATENT DOCUMENTS 2635721 2/1978 Fed. Rep. of Germany ..... 339/40

*Primary Examiner*—Neil Abrams

*Attorney, Agent, or Firm*—Kirschstein, Kirschstein, Ottinger & Cobrin

[57] ABSTRACT

A spring mounts a protective cover on an electrical outlet connector body for non-sliding, swinging movement along an arcuate path between a plug-blocking position, in which the cover blocks slots formed in the connector body, and a plug-passing position, in which openings in the cover are aligned with the connector slots. The spring includes an anchored portion securely mounted on the connector and a movable cantilever portion which is inclined relative to the anchored portion, and which is dimensioned so as to maintain the cover out of frictional engagement with the connector body between the aforementioned positions. Manual displacement of the cover is facilitated by the reduction of frictional drag.

20 Claims, 5 Drawing Figures

PROTECTED ELECTRICAL CONNECTOR

BACKGROUND OF THE INVENTION

1. Field of the Invention

The present invention relates generally to electrical outlets having a guard against electrical shock and burn and, more particularly, to a cube tap having protective plates mounted thereon.

2. Description of the Prior Art

It has long been recognized that electrical outlets present a substantial hazard to children. Children are by nature curious and this curiosity leads them to insert metallic objects into prong-admitting passageways which lead to female contacts housed in a connector. Seeing their parents insert objects into electrical outlets and imitating them, children insert what they believe to be similar objects without realizing the dangers involved. As a result, they are shocked or burned, sometimes seriously and, upon occasion, fatally.

The increasing concern for child safety has led to a safety requirement for cube taps of electrical cords. The requirement is that all, or all but one, of the pairs of prong-receiving slots of the cube taps be shielded or protected in some manner.

A number of devices have been devised for satisfying this requirement including pseudo-plugs of electrically non-conductive material which are plugged into the outlet in a manner analogous to that shown in U.S. Pat. No. 3,989,334.

Other approaches utilize a protective cover plate which is moved between a plug-blocking and a plug-receiving position by a spring. U.S. Pat. Nos. 4,094,569; 3,865,456; 3,068,442; 3,222,631; 2,820,842; 2,710,382; 2,477,803 are representative of constructions which utilize separate coil or leaf springs to slide a cover plate between the aforementioned positions.

Due to the fact that the constructions with separate springs utilize a multitude of parts and require great skill to assemble such connectors, it has been proposed in U.S. Pat. No. 3,810,070 to slide a protective cover plate directly against the elastomeric connector body itself. However, this construction is not entirely satisfactory in situations where the elastomeric material hardens due to age or due to cold temperatures. In such cases, the hard elastomeric body becomes so stiff due to the cold temperatures, that the user must exert a great amount of force to push the plate relative to the body. Another construction which eliminates separate springs is disclosed in U.S. Pat. No. 3,980,371. This patent teaches a slidable cover plate which has a one-piece spring mounted in a cavity of a connector body. Although generally satisfactory for its intended purpose, this cover has not proven to be altogether reliable in operation. First of all, the sliding movement of the cover generates a high degree of frictional drag, thereby generating a large magnitude force at the point of interconnection of the spring with the cover. This interconnection becomes progressively more stressed during repeated operation and eventually the interconnection is broken. Secondly, the spring has a very thin tip which engages a smaller flange in the cavity. It has been found that the spring does not remain in the cavity because it is not effectively restrained therein, since the tip slips off the flange by the force generated during the aforementioned sliding movement. Finally, the cover is not reliably registered in its end-limiting positions relative to the connector body.

SUMMARY OF THE INVENTION

1. Objects of the Invention

Accordingly, it is the general object of the present invention to overcome the aforementioned drawbacks of the prior art.

Another object of the present invention is to eliminate frictional drag during the movement of the protective cover between its positions.

Another object of the present invention is to effectively anchor a spring relative to a connector body.

Still another object of the present invention is to move a cover plate in a non-sliding, swinging-type motion.

Another object of the present invention is to provide a protected electrical connector which has a long working lifetime.

It is an object of the invention to provide a terminal connector of the character described which constitutes relatively few and simple parts and readily lends itself to mass production and easy, rapid assembly.

Another object of the invention is to provide a terminal connector of the character described which has an attractive appearance and which has a safety guard that, despite its ease of manipulation, still presents a sufficiently difficult problem, to provide an effective safety device for children.

Another object of the invention is to provide a terminal connector of the character described which utilizes a safety guard that, although easily assemblable to the terminal, is, when once installed, only removable with difficulty so that, in effect, it becomes a permanent part of the terminal.

Still another object of the present invention is to provide a terminal connector of the character described which incorporates a suitable arrangement for cooperating with polarized, i.e. different width prongs.

2. Features of the Invention

In keeping with these objects and others which will become apparent hereinafter, one feature of the invention resides, briefly stated, in an improved electrical outlet connector for connection with at least two electrical conductors. The outlet connector is of the type which includes a connector body which has electrically-insulating wall portions defining a wall surface, and which bounds at least one pair of open-ended slots spaced apart of each other, each slot being elongated in direction generally normally of the wall surface for receiving the prongs of an electrical plug. The connector body also includes at least one pair of electrical contacts in electrical connection with the two electrical conductors, each contact being located in a respective slot and being slidably engageable with a respective prong when the latter is inserted into the respective slot. The connector body further includes a protective cover which overlies the wall surface of the body and which has a pair of prong-receiving openings extending through the cover.

In accordance with the present invention, the improvement is embodied in anti-friction means for mounting the cover on the body for non-sliding, swinging movement along an arcuate path and about a swing axis which extends normally of the elongation of the slots between an end-limiting prong-blocking position, in which the cover engages the connector body and blocks the slots, and an end-limiting prong-passing position, in which the openings on the cover register with the slots and expose the open ends of the latter for insertion of the prongs therethrough. This improved anti-friction means constitutes a resilient spring in force-transmitting engagement with the cover, and is operative for swinging the cover out of frictional engagement with the connector body during the swinging movement. The resilient spring is dimensioned to maintain the cover out of frictional engagement with the connector body during the swinging movement along the arcuate path between the above-mentioned positions. Thus, frictional drag is eliminated during the swinging movement thereby facilitating manual displacement of the cover.

In accordance with this invention, the non-sliding movement of the cover along an arcuate path effectively obviates the generation of any large frictional force, as is common with prior art constructions which employ sliding covers which rub against the connector bodies. The cover of the present invention is easier to manipulate and does not stick against the connector bodies during use. Moreover, the spring of the present invention is not subjected to counter-forces which tend to snap the spring from the cover thereby destroying the entire utility of the connector.

Furthermore, this invention provides positive end-limiting stops to reliably register the prong-receiving openings of the cover with the prong-receiving slots of the body in one end-limiting position, as well as properly orienting the cover relative to the body in the other end-limiting position.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
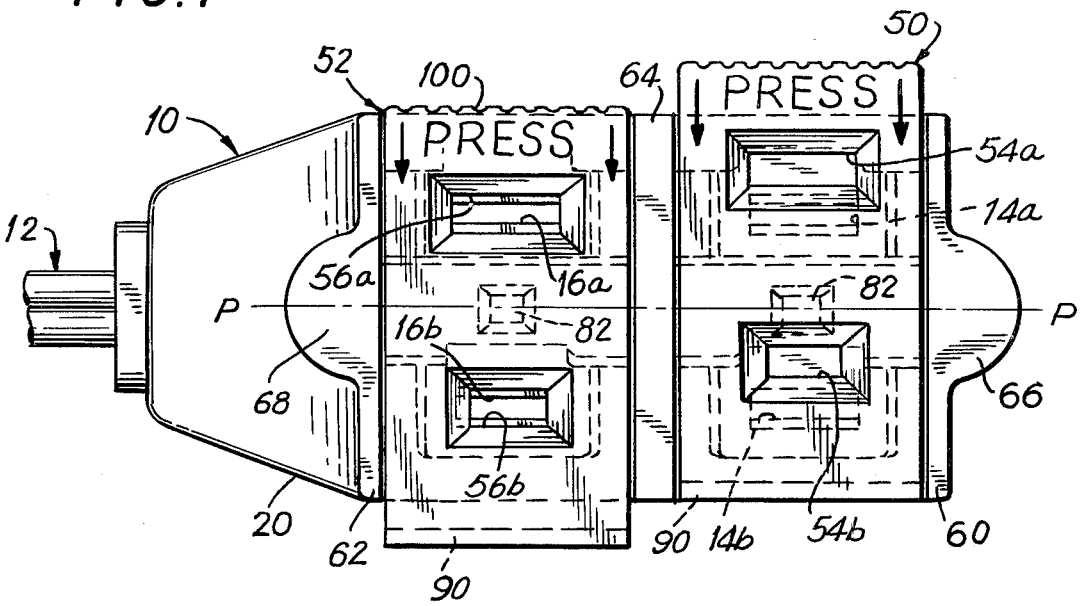
FIG. 1 is a top plan view of a terminal electrical outlet connector for an extension cord and shows one protective cover in a plug-blocking position and another protective cover in a plug-passing position, in accordance with the present invention.
Figure 2:
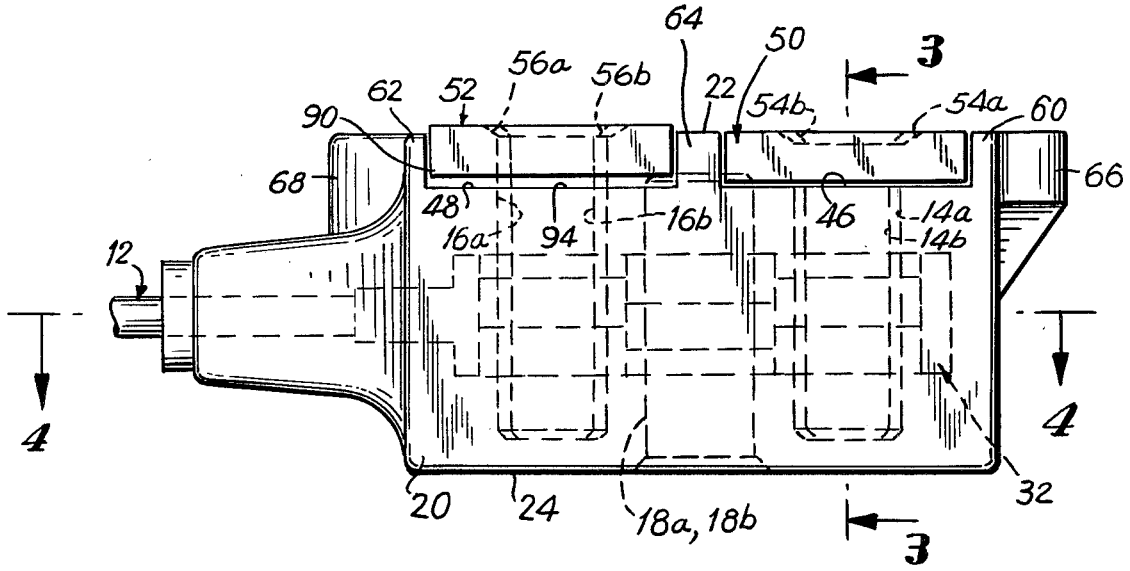
FIG. 2 is a side view of the electrical outlet of FIG. 1.
Figure 5:
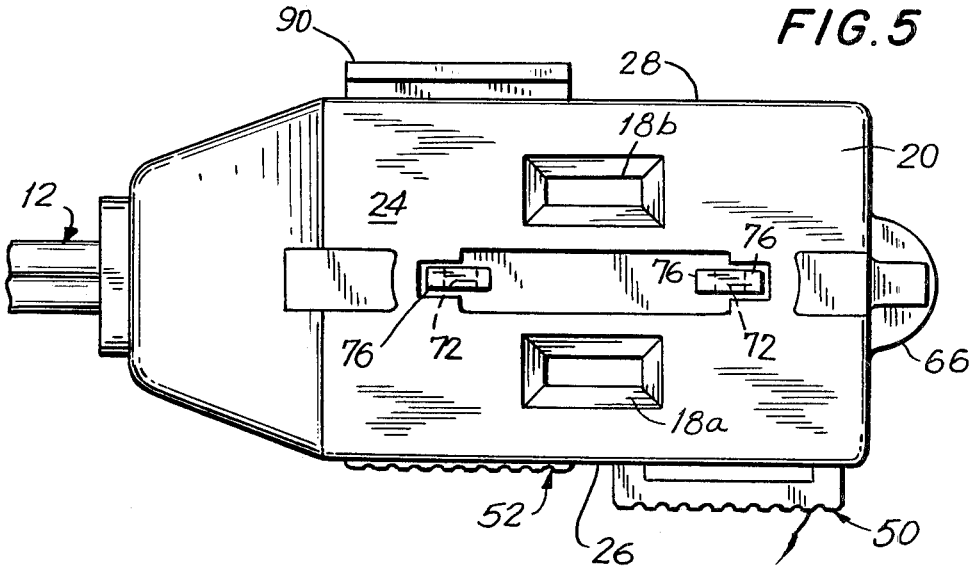
FIG. 5 is a bottom plan view of the electrical outlet of FIG. 1.

Referring now to FIG. 1 of the drawings, the electrical outlet connector 10 is a terminal connector, i.e. a cube tap, for an electrical extension cord 12. The particular cube tap illustrated has three sets of parallel prong-receiving slots. These are illustrated as two pairs of prong-receiving slots 14*a*, 14*b*, 16*a*, 16*b* on the top face of the cube tap as shown in FIG. 1, and as a third pair of slots 18*a*, 18*b* on the opposite bottom face of the tap as shown in FIG. 5.

Top slot pairs 14*a*, 14*b* and 16*a*, 16*b* are polarized. Slots 14*a*, 16*a* are wider than their associated slots 14*b*, 16*b*. A non-illustrated polarized electrical plug having male-type prongs of different widths can therefore be properly inserted in the top slot pairs. Of course, the top slot pairs need not be polarized and can have the same width as exemplified by the bottom slot pair 18*a*, 18*b*.

It will be expressly understood that any number of slot pairs can be provided on either the top and/or the bottom and/or side walls of the cube tap without departing from the spirit of this invention. If desired, each slot pair can be provided with a third slot for reception of a ground prong of a three-wire, three-prong grounded plug. Although this invention will be described in connection with a cube tap, it is to be expressly understood that this invention is not intended to be so limited, but also includes electrical convenience wall outlets and any other electrical device having female-type sockets in electrical connection to at least two wire conductors, and to which access is to be respectively barred and permitted, as required.

The cube tap 10 comprises a connector body 20 of a molded plastic construction. The plastic body 20 has a predetermined hardness, preferably polyvinyl chloride having a Shore durometer characteristic in the vicinity of 40–70 is employed. The electrically insulating walls of the body 20 form a generally rectangular parallelepiped configuration having a top wall surface 22, a bottom wall surface 24 and side walls 26, 28. Top slot pairs 14*a*, 14*b*, 16*a*, 16*b*, extend from their open ends at the top surface 22 towards the lower surface 24 but terminate short thereof. Bottom slot pair 18*a*, 18*b* extends from its open ends at the bottom surface 24 towards the top surface 22, but terminates short thereof. All of the slots are in mutual parallelism and are each elongated generally normally of the respective top and bottom walls.

Figure 4:
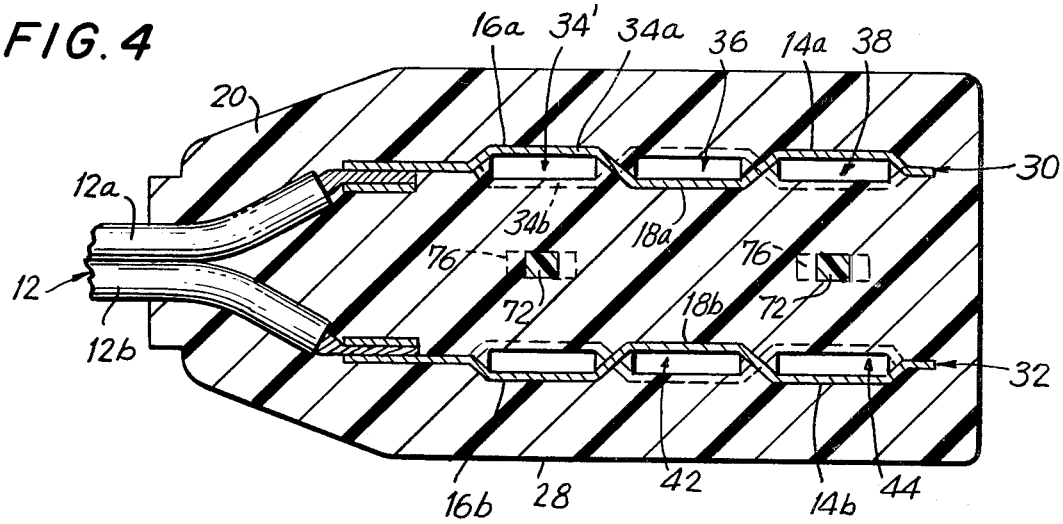
FIG. 4 is a sectional view as taken along line 4—4 of FIG. 2.

As shown in FIG. 4, a pair of parallel conductor strips 30, 32 are embedded within body 20. Each strip has a plurality of pairs of metal contact portions arranged lengthwise of the respective strip. Each pair of metal contact portions is located in a respective slot and bounds a prong-receiving slit which is aligned with each prong-receiving slot. Thus, representative metal contact parts 34*a*, 34*b*, are located in slot 16*a* and are spaced apart of each other to define a prong-receiving slit 34' which is aligned with slot 16*a*. Upon insertion of a prong of an electrical plug into slot 16*a*, this prong slidably and frictionally engages the metal contact portions 34*a*, 34*b* and establishes an electro-mechanical connection therewith. The same structural and functional relationships are present for the metal contact parts 36, 38 of the strip 30 and for the metal contact parts 40, 42, 44 of the strip 32. The extension cord 12 has two conductors 12*a* and 12*b* which are electrically connected to the strips 30, 32 in conventional manner such as by soldering or mechanical crimping on the inboard ends of the conductors.

The top wall 22 is grooved to form two wide and generally parallel grooves to function as guideways 46, 48 of the generally planar protective cover plates 50, 52. Upstanding end guides 60, 62 at opposite ends of the body, and central guide 64 located midway between the end guides all serve to guide the protective covers 50, 52 along their respective guideways 46, 48 in a manner to be described below, as well as serving to prevent the covers from rotating about an axis which extends parallel to the elongation of the slots.

Covers 50, 52 have respective pairs of openings 54a, 54b, 56a, 56b which extend through the cover and which overlie the top wall 22 of the body. Each pair of cover openings is spaced apart of each other at the same distance as the prong-receiving slots formed in the body in order to receive the electrical plug prongs. Openings 54a, 56a are slightly wider than their associated openings 54b, 56b in order to accommodate polarized prongs.

The cover 50 at the right side of FIG. 1 is in its normal position and shows the cover openings offset from the body slots, i.e. in a plug-blocking position, so as to safeguard a child from injury. The cover 52 at the left side of FIG. 1 is in the displaced position and shows the cover openings in registration with the body slots, i.e. in a plug-passing position. The present invention is concerned with effecting this movement between these positions in a novel manner as described below.

Before turning to a description of this unique movement, the body 20 is further formed with semi-circular bosses 66, 68 at opposite ends thereof. The bosses serve as abutments for the ground prong of a three-wire three-prong connector. This prevents a user from interchanging two-and three-prong cord connectors. If desired, the width of the cover itself can be increased so that the ground prong is effectively barred from being connected to the cube tap.

The prong-receiving slots 18a, 18b have not been provided with an overlying cover. If desired, a cover can be provided which overlies the bottom wall of the cube tap.

Figure 3:
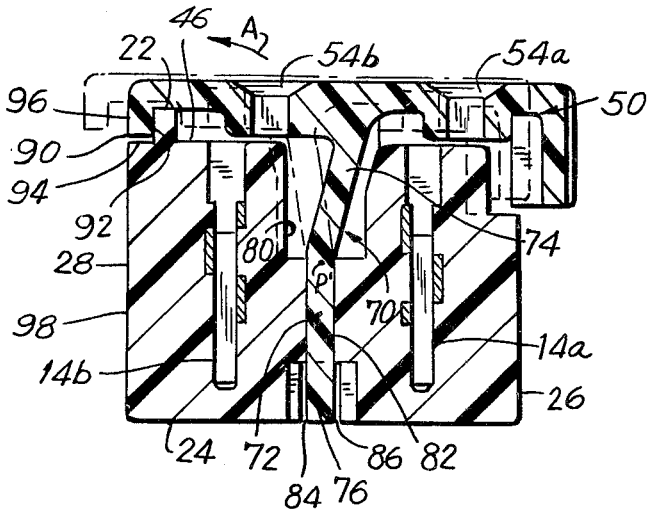
FIG. 3 is a cross-sectional view as taken along line 3—3 of FIG. 2 and shows the protective cover in the plug-passing position in phantom lines.

Turning now more particularly to FIG. 3, anti-friction means 70 are provided for mounting each protective cover on the body for non-sliding, swinging movement along an arcuate path in direction of the arrow A, and about a swing axis P—P, which extends normally of the elongation of the slots. The anti-friction means 70 constitute a resilient spring for each cover, and the spring is in force-transmitting engagement with, and preferably is of one-piece with, each cover. As will be shown herein, a spring 70 is operative for swinging each cover out of frictional engagement with the body and for maintaining each cover out of frictional engagement with the body during the swinging movement between the two aforementioned end-limiting positions of the cover. This feature eliminates frictional drag during the swinging movement and facilitates manual displacement of the cover during use.

Each spring 70 comprises an anchored portion which consists of a mounting portion 72, and an enlarged portion 76 at the end of the spring that is most remote from the cover. Each spring also comprises a cantilever portion 74 which is movable relative to the anchored portion and which is pivotable about the point P' which lies on the swing axis P—P.

For each spring, the body 20 is formed with a corresponding cavity 80 in which the cantilever portion 74 is received with clearance so as to accommodate the cantilever portion during its entire range of movement. The body is also formed with a pair of mounting holes 82 in which the respective mounting portions 72 are frictionally received. Each mounting hole 82 and each mounting portion 72 is preferably of non-circular configuration, i.e. rectangular, as shown. Of course, other complementary cross sections such as circular, hexagonal, etc., could also be employed.

The cantilever portion 74 is also preferably of rectangular configuration, but other configurations such as circular and other non-circular configurations can be used. The body is also formed with a bore 84 having a base wall 86 and in which the enlarged portion 76 is received. The enlarged section 76 may have a generally rectangular parallelepiped configuration, as shown, or a generally conical configuration or any other three-dimensional configuration. The enlarged portion 76 forms a shoulder with the mounting portion 72, and this shoulder engages base wall 86 to thereby prevent undesired axial withdrawal of the enlarged portion from the bore. Concomitantly, this engagement of the enlarged section and the base wall anchors the spring 70 in proper position on the body. In the embodiment shown, the shoulder has a rectangular face, whereas for conically-shaped enlarged sections, the shoulder would have an annular face. Of course, other differently configurated abutment faces can be utilized.

Each cover and its associated spring is of one-piece molded plastic having a hardness which is harder than said predetermined hardness of the body. Preferably, a hard polycarbonate or nylon material, having a Shore durometer characteristic of about 100, is employed. In order to assemble the combined spring and cover unit on the body, enlarged portion 76 is passed first through the cavity 80, and thereupon through mounting hole 82, wherein the walls bounding the hole 82 are deformed and pushed radially aside due to the relatively larger-sized cross-sectional dimension of the enlarged section and also due to the different hardness of the spring relative to the connector body material.

Finally, the enlarged portion snaps into the space in the bore 84. The walls bounding the mounting hole 82 resume their initial position in tight frictional engagement with the mounting portion 72 after the enlarged portion 76 has cleared the mounting hole 82.

In FIG. 3, the spring is shown in its non-working end-limiting position. The cover has a stop flange 90 which extends downwardly from the planar cover. The stop 90 is preferably located at a distance away from the spring 70 such that the stop 90 abuts against the abutment surface 92 of the notch 94 under the influence of a force which tends to constantly urge the stop 90 with an affirmative frictional engagement against the abutment surface 92. In a preferred embodiment, the spring 70 is so molded of resilient plastic that the cantilever portion is inclined at a large obtuse angle relative to the mounting portion 72. In this case, the spring normally assumes the solid line, illustrated, slightly stressed position, thereby always biasing the cover to the illustrated offset or prong-blocking position. In this end-limiting position, the lower surface of the cover either engages, or is spaced slightly from, the body at a top wall portion 22, and the stop 90 is affirmatively and constantly urged against abutment surface 92.

The purpose of the stop flange 90 is to reliably insure that the outer surface 96 of the stop 90 is substantially flush or in a desired orientation relative to the outer side surface 98 of the body 28. We have found that manufacturing tolerances in the curing and fabrication of the plastic molded spring are such that the flange 90 may in certain instances overhang or improperly register with the body, thereby imparting an unattractive cosmetic appearance to the overall connector. Therefore, by molding the cantilever portion 74 at an obtuse angle slightly greater than that illustrated, the finally cured and molded cover and spring sub-assembly will always be constantly urged in a direction towards the right in FIG. 3. The stop 90 thus will not improperly register with the body and will always be located in a predetermined orientation, thereby providing uniformity of appearance which is especially important in mass production and when more than one cover is used on a single connector.

The cantilever portion of the spring shown in FIG. 3 is in the slightly stressed state as described above. Of course, the cantilever portion could also be molded so as to be normally unstressed or in a relaxed state. The important criterion for the relaxed cantilever portion is that the prong-receiving slots are blocked by the cover.

In use, the cover is manually displaced and the cantilever portion (which is either slightly stressed or completely relaxed) is moved from its initial inclined position to a final position in which the cantilever portion is approximately co-planar with the mounting portion. Preferably, the cantilever portion 74 passes through the plane in which the mounting portion 72 lies and defines an obtuse angle relative to the other side of the mounting portion 72. In this final position, as shown in phantom lines, the cantilever portion is in a highly stressed state, i.e. is more highly stressed as compared to its initial non-working position. The cantilever portion, therefore, always exerts a restoring torque in which the cantilever portion seeks to return to its less stressed state. Additionally, the softer resilient material of the connector body may also be slightly displaced and stressed during the displacement of the cover. Thus, the material of the body itself may also generate a restoring torque and assist the cantilever portion in moving the cover back to its initial position.

During this movement, the cantilever portion pivots or swings about the pivot point P' along the arcuate path A. As it moves from its inclined to its more aligned orientation relative to the mounting portion 72, the cover is lifted in direction both slightly upwardly away from the top wall portion 22 and also circumferentially of the pivot point P'. The cover never frictionally engages the connector body during this swinging movement between the aforementioned plug-blocking and plug-passing positions because the length of the cantilever portion, and the pivoting of the latter about pivot point P', insures that the cover is always spaced above the body during this swinging movement. As noted above, this lack of friction permits a user to more easily displace the cover, as compared to prior art constructions. Moreover, no great stress forces are generated at the interconnection between the cantilever portion and the cover to thereby cause the spring to snap off the cover during repetitive use.

In order to facilitate registration of the cover openings with the body slots, movement of the cover may be stopped at the prong-passing position by engagement of the cover, or by engagement of the cantilever portion, with a portion of the connector body. The stop serves to insure that the cover openings align with the body slots.

Displacement of the cover is facilitated by hand-gripping means 100 on a cover end region which overhangs the body. Hand-gripping means 100 constitutes a roughened surface such as the sequence of notches formed at the edge of covers 50, 52. Other hand-gripping means, such as a single indentation which can accomodate a finger, may also be utilized. In addition, indicia such as "PRESS" and/or the representation of an arrow on the top surface of the covers serve as aids to indicate to a user which way the cover is to be pushed.

It is also within the spirit of this invention to mold the cover and spring sub-assembly such that the cantilever portion is not inclined relative to its mounting portion, i.e. such that the cantilever portion is at a right angle relative to the plane of the cover. In this case, the cantilever portion will be displaced from an initial, upright, prong-blocking position to a final inclined prong-passing position. During the displacement of the cantilever portion, the body will yield to the force applied to the cover due to the much softer resilient material of the body as compared to the cover. In this case, the body material itself is displaced and stressed so that the tensed body will cooperate with the stressed cantilever portion to return the latter to its initial position.

It will be understood that each of the elements described above, or two or more together, may also fine a useful application in other types of constructions differing from the types described above.

While the invention has been illustrated and described as embodied in a protected electrical outlet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an improved electrical outlet connector for connection with at least two electrical conductors, said outlet connector being of the type including (A) a connector body having electrically-insulating wall portions defining a wall surface, and bounding at least one pair of open-ended slots spaced apart of each other, each slot being elongated in direction generally normally of the wall surface for receiving the prongs of an electrical plug, said wall portions also bounding a mounting hole, (B) at least one pair of electrical contacts in electrical connection with the two electrical conductors, each contact being located in a respective slot and being slidably engageable with a respective prong when the latter is inserted into the respective slot, and (C) a protective cover overlying the wall surface of the body and having a pair of prong-receiving openings extending through the cover, the improvement which comprises:

(i) anti-friction means for mounting the cover on the body for non-sliding, swinging movement along an arcuate path and about a swing axis which extends normally of the elongation of the slots between an end-limiting prong-blocking position, in which the cover engages the connector body and blocks the slots, and an end-limiting prong-passing position, in which the openings on the cover register with the slots and expose the open ends of the latter for insertion of the prongs therethrough, said anti-friction means constituting a resilient spring in force-transmitting engagement with the cover and operative for swinging the cover out of frictional engagement with the connector body during the swinging movement, said spring being dimensioned to maintain the cover out of frictional engagement with the connector body during the swinging movement along the arcuate path between said positions, whereby frictional drag during the swinging movement is eliminated to thereby facilitate manual displacement of the cover, said spring having an anchored portion secured on the connector body, and a cantilever portion movable relative to said anchored portion, said anchored portion having a mounting section which is received in said mounting hole and which has a cross-sectional dimension of predetermined size, and an enlarged section which has a cross-sectional dimension of size greater than said predetermined size so as to define a shoulder with said mounting section, said shoulder being in engagement with the connector body to thereby prevent removal of the spring from the connector body.

2. The improvement as defined in claim 1, wherein said cantilever portion is movable from a less stressed state at said prong-blocking position to a more stressed state at said prong-passing position.

3. The improvement as defined in claim 1, wherein said cantilever portion is inclined relative to said anchored portion at said prong-blocking position.

4. The improvement as defined in claim 1, wherein said cantilever portion and said anchored portion are approximately co-planar at said prong-passing position.

5. The improvement as defined in claim 1, wherein said anchored portion is of one-piece molded plastic construction with said cantilever portion which is of one-piece molded plastic construction with said cover.

6. The improvement as defined in claim 5, wherein said connector body is of a plastic material having a predetermined hardness, and wherein said one-piece spring and cover construction is of a plastic material having a hardness which is greater than said predetermined hardness.

7. The improvement as defined in claim 1, wherein said wall portions of said connector body also bound a cavity in which said cantilever portion is received with clearance, and a bore having a base wall and in which said enlarged section of said anchoring portion is received; and wherein said shoulder engages said base wall to thereby prevent withdrawal of said enlarged section from said bore.

8. The improvement as defined in claim 7, wherein said mounting hole and said mounting section each have a non-circular cross-section.

9. The improvement as defined in claim 1; and further comprising stop means for arresting said cover at said end-limiting prong-passing position.

10. The improvement as defined in claim 1; and further comprising stop means for arresting said cover at said end-limiting prong-blocking position.

11. The improvement as defined in claim 10, wherein said stop means includes a stop flange of one piece with the cover.

12. The improvement as defined in claim 1, wherein an additional pair of slots are formed in the connector body, and wherein an additional pair of electrical contacts are located in said additional pair of slots, and wherein an additional protective cover overlies said additional pair of slots; and further comprising additional anti-friction means associated with said additional cover in a manner analogous to said first-mentioned anti-friction means.

13. The improvement as defined in claim 1, wherein the open ends of said one pair of slots have different widths for receiving in correct orientation the different widths of the prongs of a polarized plug.

14. The improvement as defined in claim 1, wherein the electrical outlet connector is a terminal connector for an electrical extension cord which has a pair of electrical conductors.

15. The improvement as defined in claim 14, wherein the terminal connector has three pairs of open-ended slots formed in the connector body, two pairs being located at said wall surface and the remaining pair being located at an opposite wall surface.

16. The improvement as defined in claim 15, wherein each pair of slots has a pair of electrical contacts therein, and wherein all of said electrical contacts constitute a pair of conductor strips located within the body, each strip having three prong-receiving slits, one each associated with each of the prong-receiving slots; and wherein each strip has a connecting portion which is electrically connected to the pair of electrical conductors of the extension cord.

17. The improvement as defined in claim 14; and further comprising an abutment boss located on the connector body adjacent said one pair of slots, said boss serving as a permanent abutment for the ground prong of a three-prong plug to prevent interchangeability between two- and three-prong plugs.

18. The improvement as defined in claim 1; and further comprising hand-gripping means on said cover for facilitating manual displacement of the cover.

19. The improvement as defined in claim 1; and further comprising indicia on the cover for indicating the direction in which to manually displace the cover.

20. An improved electrical outlet connector for connection with at least two electrical conductors, comprising (A) a connector body being constituted by a resilient material of a predetermined hardness and having electrically-insulating wall portions defining a wall surface, and bounding at least one pair of open-ended slots spaced apart of each other, each slot being elongated in direction generally normally of the wall surface for receiving the prongs of an electrical plug, said wall portions also bounding a mounting hole;

(B) at least one pair of electrical contacts in electrical connection with the two electrical conductors, each contact being located in a respective slot and being slidably engageable with a respective prong when the latter is inserted into the respective slot;

(C) a protective cover overlying the wall surface of the body and having a pair of prong-receiving openings extending through the cover, said cover being constituted by a resilient material of a hardness which is greater than said predetermined hardness; and (D) biasing means for mounting the cover on the body for movement relative to the latter between an end-limiting prong-blocking position, in which the cover engages the connector body and blocks the slots, and an end-limiting prong-passing position, in which the openings on the cover register with the slots and expose the open ends of the latter for insertion of the prongs therethrough, said biasing means being of one-piece with the cover and including an anchored portion secured on the connector body, and a cantilever portion located between the anchored portion and the cover, said cantilever portion being movable from a less stressed state at said prong-blocking position to a more stressed state at said prong-passing position, said anchored portion having a mounting section which is received in said mounting hole and which has a cross-sectional dimension of predetermined size, and an enlarged section which has a cross-sectional dimension of size greater than said predetermined size so as to define a shoulder with said mounting section, said shoulder being in engagement with the connector body to thereby prevent removal of said biasing means from said connector body.

* * * * *